US008678094B2

(12) United States Patent
Banks

(10) Patent No.: US 8,678,094 B2
(45) Date of Patent: Mar. 25, 2014

(54) MULTIPLE ACTIVITY RIG

(75) Inventor: John Banks, Aberdeen (GB)

(73) Assignee: Stena Drilling Ltd., Aberdeen (GB)

( * ) Notice: Subject to any disclaimer, the term of this patent is extended or adjusted under 35 U.S.C. 154(b) by 1412 days.

(21) Appl. No.: 11/597,016

(22) PCT Filed: Jun. 1, 2005

(86) PCT No.: PCT/IB2005/002362

§ 371 (c)(1),
(2), (4) Date: Nov. 17, 2006

(87) PCT Pub. No.: WO2005/118999

PCT Pub. Date: Dec. 15, 2005

(65) Prior Publication Data

US 2007/0251725 A1 Nov. 1, 2007

Related U.S. Application Data

(60) Provisional application No. 60/576,156, filed on Jun. 2, 2004.

(51) Int. Cl.
*E21B 19/14* (2006.01)
*E21B 19/00* (2006.01)

(52) U.S. Cl.
CPC ..... *E21B 19/004* (2013.01); *E21B 19/143* (2013.01)
USPC ..... 166/352; 166/358; 166/367; 175/5

(58) Field of Classification Search
CPC ..... E21B 19/004; E21B 19/143; E21B 7/12; E21B 7/20; B63B 35/4413
USPC ..... 166/344, 338–341, 358–360, 366–368, 166/352; 175/5–10; 405/184.4, 201, 224.2; 414/22.51–22.71
See application file for complete search history.

(56) References Cited

U.S. PATENT DOCUMENTS 3,895,677 A * 7/1975 Bokenkamp ..... 166/359
3,981,369 A * 9/1976 Bokenkamp ..... 175/5
4,007,782 A * 2/1977 Nybo et al. ..... 166/79.1
4,044,895 A * 8/1977 Adair ..... 414/22.63

(Continued)

FOREIGN PATENT DOCUMENTS

GB 2 291 664 1/1996

OTHER PUBLICATIONS

"Stena DrillMAXX, A dual mast, dynamically positioned, harsh environment, ultra deepwater drillship", Stena Drilling Limited.

(Continued)

*Primary Examiner* — Matthew Buck
(74) *Attorney, Agent, or Firm* — Trop, Pruner & Hu, P.C.

(57) ABSTRACT

An offshore platform may include a pair of trolleys. One trolley may be mounted on top of the platform and the other trolley may be suspended below the platform. Each trolley may be positioned on opposed sides of a moon pool in one embodiment of the present invention. The lower trolley may be used to hang off a riser and blowout preventer. The upper trolley may be utilized to hang off smaller diameter casing while larger diameter casing is being made up and positioned within the hole. As a result of the parallel operations made possible by the trolleys, drilling time may be reduced in some embodiments.

10 Claims, 9 Drawing Sheets

(56) References Cited

U.S. PATENT DOCUMENTS

| | | | | | |
|---|---|---|---|---|---|
| 4,288,177 | A * | 9/1981 | Schoonmade | 405/196 |
| 4,367,796 | A * | 1/1983 | Bolding | 166/341 |
| 4,574,241 | A * | 3/1986 | Stelly | 324/326 |
| 4,708,563 | A * | 11/1987 | Van Den Berg et al. | 414/22.66 |
| 4,716,972 | A * | 1/1988 | Makinen et al. | 175/8 |
| 4,819,730 | A * | 4/1989 | Williford et al. | 166/355 |
| 4,899,682 | A * | 2/1990 | Pouget et al. | 114/264 |
| 5,647,443 | A * | 7/1997 | Broeder | 175/5 |
| 6,047,781 | A * | 4/2000 | Scott et al. | 175/5 |
| 6,056,071 | A * | 5/2000 | Scott et al. | 175/5 |
| 6,068,069 | A * | 5/2000 | Scott et al. | 175/5 |
| 6,085,851 | A * | 7/2000 | Scott et al. | 175/7 |
| 6,217,258 | B1 * | 4/2001 | Yamamoto et al. | 405/201 |
| 6,321,675 | B1 * | 11/2001 | Dybdahl et al. | 114/264 |
| 6,766,860 | B2 * | 7/2004 | Archibald et al. | 166/341 |
| 6,902,007 | B1 * | 6/2005 | Orr et al. | 166/379 |
| 6,926,488 | B1 * | 8/2005 | Bolding et al. | 414/22.62 |
| 6,955,223 | B2 * | 10/2005 | Orr et al. | 166/378 |
| 7,086,474 | B1 * | 8/2006 | Trevithick et al. | 166/379 |
| 2003/0159853 | A1 | 8/2003 | Archibald et al. | |

OTHER PUBLICATIONS

Preliminary Proposal from Smedvig Dual Operation Drilling, Feb. 1996.

Malaysia Patent Office, Substantive Examination Report for Application No. PI 20052521, 5 pages, Jul. 31, 2008.

* cited by examiner

MULTIPLE ACTIVITY RIG

CROSS-REFERENCE TO RELATED APPLICATION

This application is based on provisional application No. 60/576,156, filed Jun. 2, 2004.

BACKGROUND

This invention relates generally to offshore drilling of wells using floating and non-floating platforms.

A floating platform may be moved to a position over a potential well location. The well may be drilled and may be coupled to the rig by a marine riser. Conventionally, there is a substantial distance between the floating platform and the seabed surface. For example, this distance may be several thousand feet. As a result, it is necessary to lower various drill strings, casings, and risers from the surface to the seabed floor.

The cost associated with drilling wells with offshore floating platforms may be substantial. For example, rental rates for offshore mobile platforms may run in the range of $300,000.00 a day. Significant time may be spent running various equipment from the rig down to the subsea floor. This time may result in a substantial portion of the cost.

Often, it is desirable to drill one well, pick up, and move to another location. The need to connect to a well from the surface involves substantial expenditure of time and, therefore, expense.

To address these problems, so-called dual activity rigs have been proposed. In a dual activity rig there may be two derricks, including a main derrick, used for running and hanging off the blowout preventer, and an auxiliary derrick, used to drill the top hole and run surface casing. A blowout preventer riser may be hung off from the rig while the drill string is operating to form the hole.

Dual operations may save time from the time a rig arrives on location to the landing of the blowout preventer. This is because the riser and the blowout preventer can be made up and run off line.

Thus, there is a need for still better ways to save time during offshore floating platform drilling activities.

DETAILED DESCRIPTION

Figure 1:
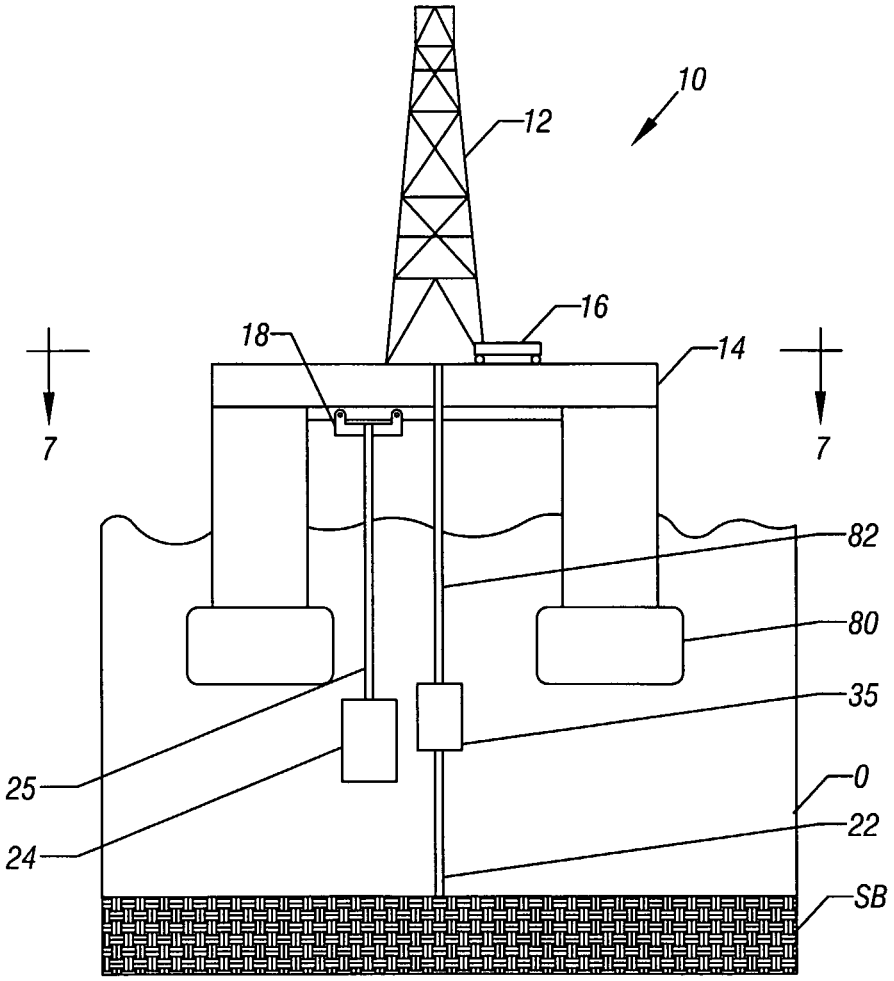
FIG. 1 is a schematic, cross-sectional view of one embodiment of the present invention in the course of jetting casing into a seabed.

Referring to FIG. 1, a floating platform or multiple operation drilling rig 10 is shown in position over a formation. The rig 10 may include a single derrick 12, which may include multiple levels for different operations. In some embodiments, more than one derrick may be utilized. In the embodiment illustrated, the deck 14 supports an upper trolley 16 and a lower trolley 18. The upper trolley 16 may ride on the deck 14 and the lower trolley 18 may ride on the track beneath the deck 14.

Also beneath the deck 14 are the floats 80. Suspended downwardly is a string 82 coupled to a guide base 35. The guide base 35 is intended to be positioned on the seabed floor (SB) but, in FIG. 1, is shown being lowered within the ocean (O). Below the guide base 35 is a larger diameter casing or conductor 22 in accordance with one embodiment of the present invention. The larger diameter casing 22 may be a 36" casing in one embodiment. The lowermost end of the casing 22 includes a plurality of high pressure jets capable of displacing the seabed floor and forming a hole that will receive the casing 22.

In the position shown in FIG. 1, the riser 25 and blowout preventer 24 are hung off of the lower trolley 18 out of position from the drill string 82. For example, the rig 10 may have just arrived from a prior drilling site. It may have arrived with the riser 25 and blowout preventer 24 hung off of the trolley 18. As a result, there is no need to spend the time making up of the riser 25 and attaching the blowout preventer 24 because that equipment is already in position, hung off of the rig 10.

Upon arriving at the drilling site, all that would be necessary then is to connect the guide base 35 to the larger diameter casing. In one embodiment, about 4 joints of 36" casing may be secured to the guide base 34 so that the guide base 35 and casing 22 can be lowered on the string 82 to the seabed floor (SB).

Figure 2:
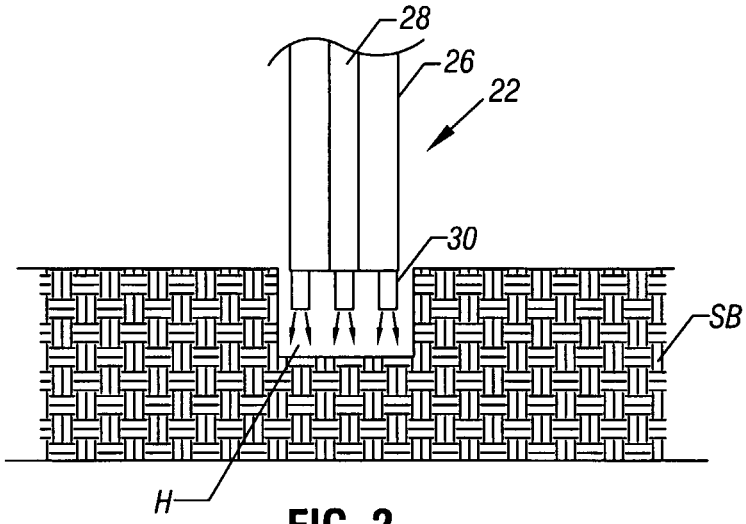
FIG. 2 is a partial, enlarged, cross-sectional view of a portion of the casing in position over the seabed floor in accordance with one embodiment of the present invention.

Referring to FIG. 2, once the casing 22 is at the seabed floor, a plurality of high pressure fluid jets 30 may receive pumped fluid and jet that fluid to form a hole H in the seabed floor ahead of a casing 22. Thus, as the casing 22 is advanced into the seabed floor, a hole is jetted by an array of three jets 30 in accordance with one embodiment of the present invention. This hole is sufficiently large to enable the casing 22 to be jetted into the seabed floor (SB) and to position the guide base 35 on the seabed floor. Thus, high pressure fluid may be pumped down from the rig 10 and ejected from the jets 30 to remove seabed sediment.

Figure 3:
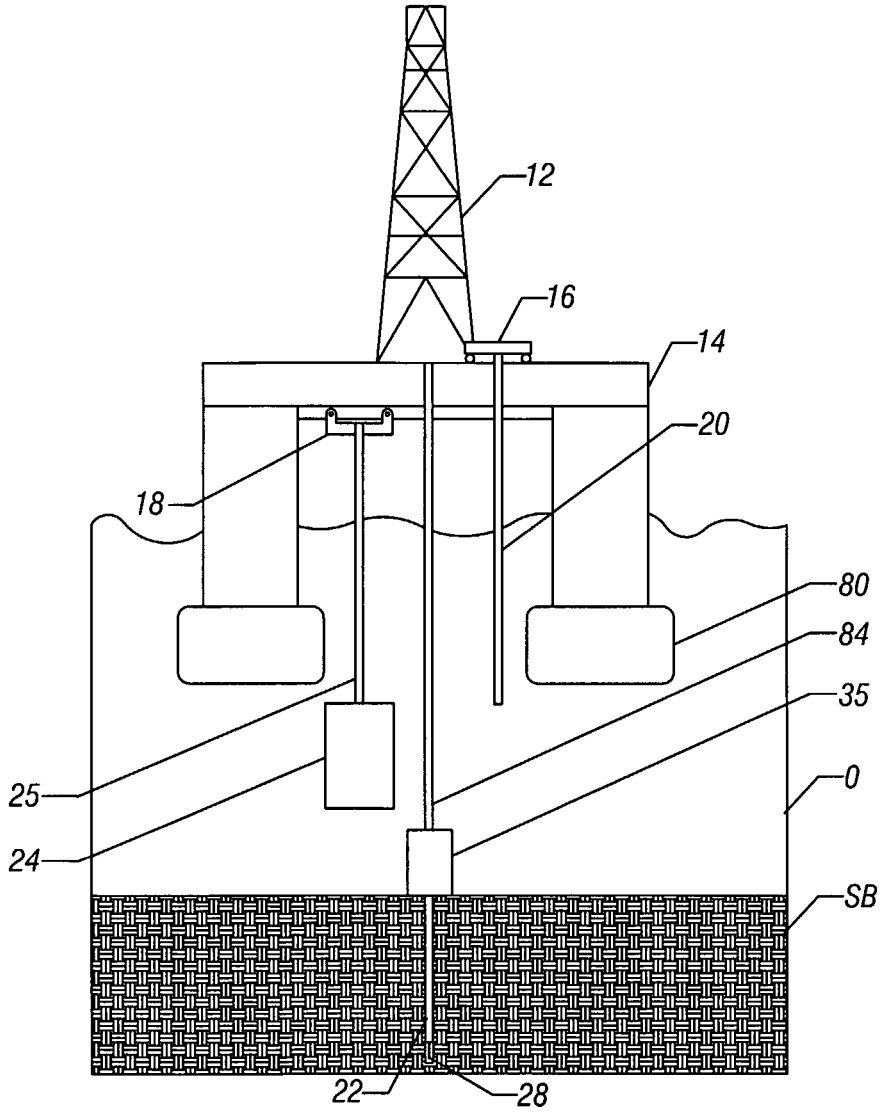
FIG. 3 is a cross-sectional view of the embodiment shown in FIG. 1 after the casing has been jetted into the seabed floor, during drilling of a smaller diameter hole below that casing in accordance with one embodiment of the present invention.

Referring to FIG. 3, after the casing 22 is in place within the seabed floor (SB) and the guide base 35 is in position on the seabed floor, a smaller diameter bottom hole assembly or drill string 28 may be released ahead of the casing 22. Then, a smaller diameter hole is drilled using the bottom hole assembly 28 as shown in FIG. 3. In effect, the bottom hole assembly 28 simply advances downwardly through the now stationary casing 22. In one embodiment, the smaller diameter hole may be about either 26" or 17½" in diameter.

Figure 4:
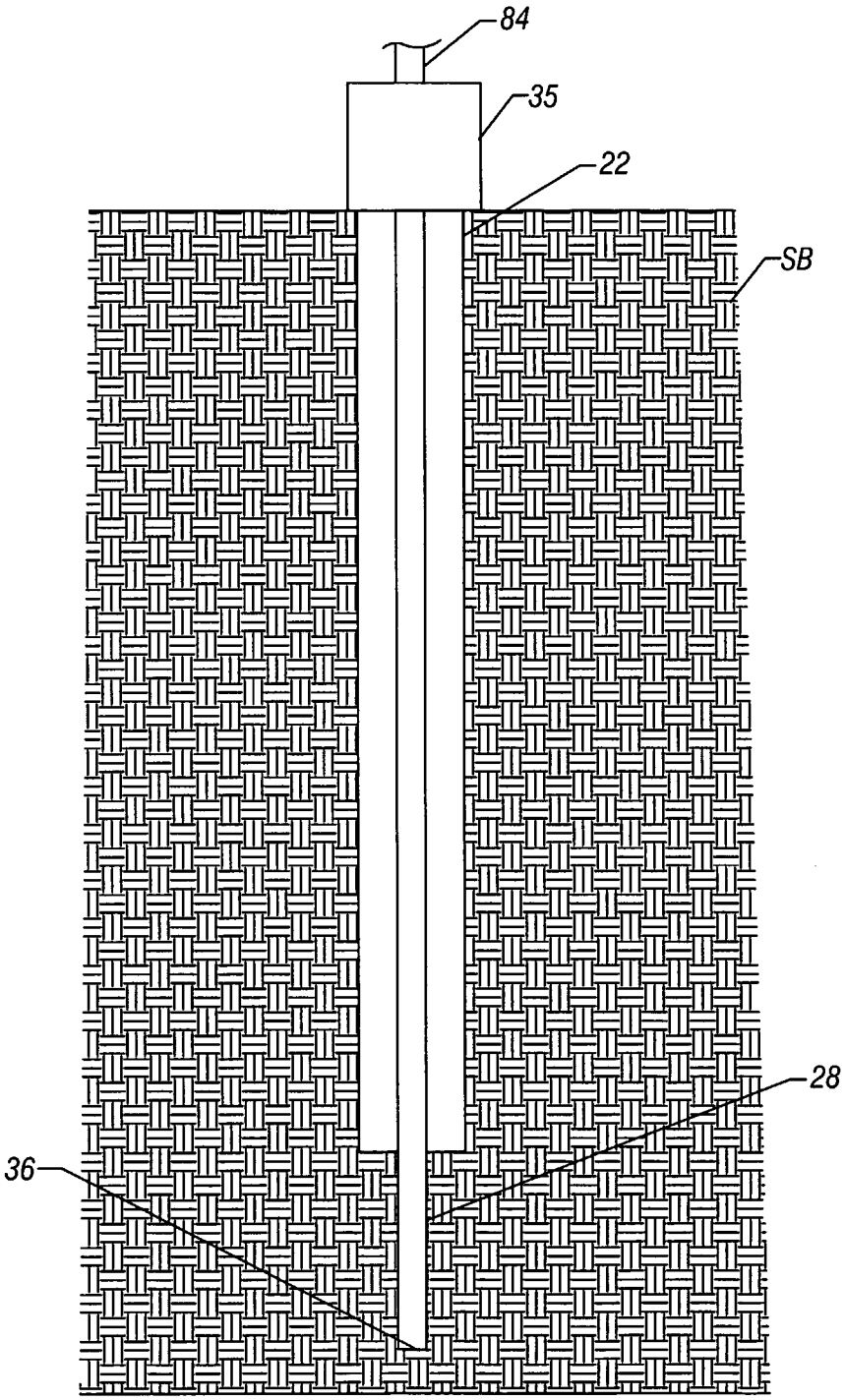
FIG. 4 is a partial, enlarged, cross-sectional view of the embodiment shown in FIG. 3 in the course of drilling a smaller diameter hole below a larger diameter casing in accordance with one embodiment of the present invention.

Thus, as shown in FIG. 4, an ever-deeper hole 36 is formed as a result of the drilling bit (not shown) operating on the end of the bottom hole assembly 28. The depth of the hole 36 that is drilled is limited to prevent the bottom hole assembly 28 from reaching a high pressure formation within the seabed floor. Namely, because no blowout preventer is in place at this time, it is desirable to drill a relatively shallow hole 36 without penetrating any high pressure formations.

Figure 5:
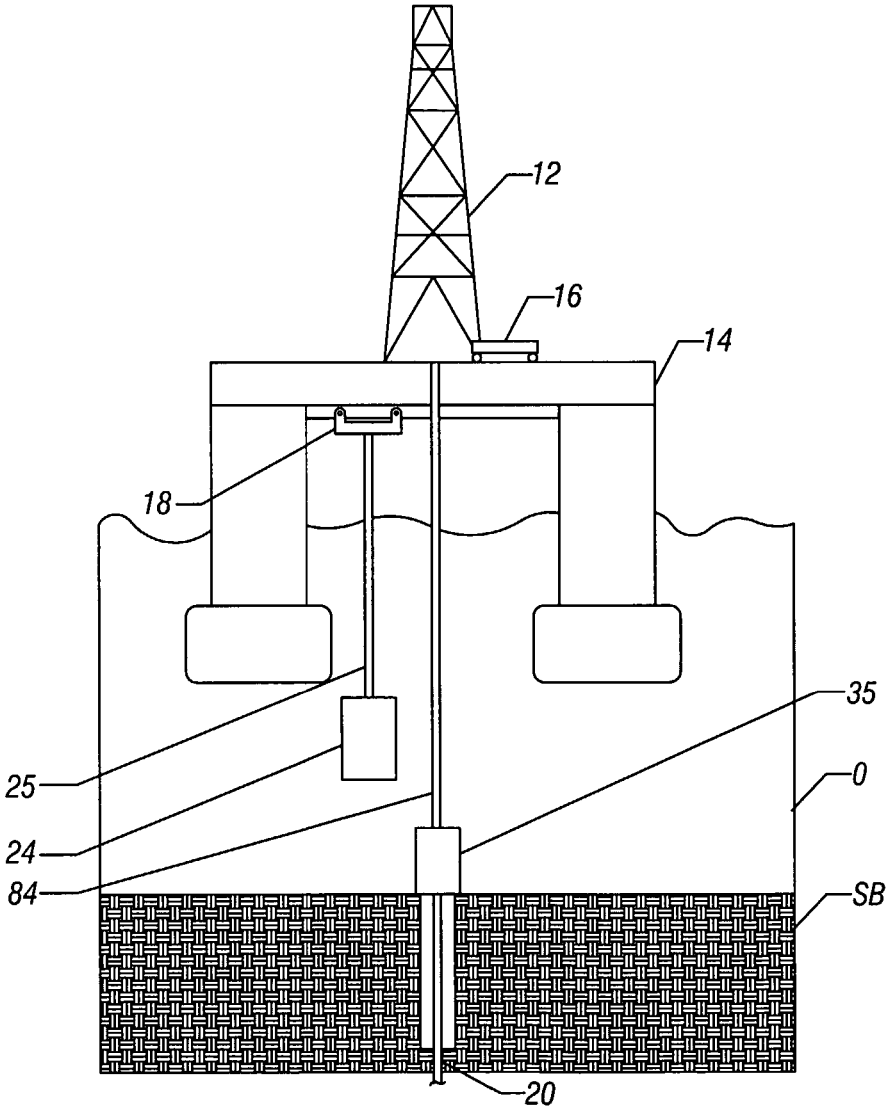
FIG. 5 is a cross-sectional view showing the smaller diameter casing in one embodiment.

The bottom hole assembly 28 is pulled out of the hole 36. Then, the smaller diameter casing 20 is run into the hole 36, which may just be formed by the bottom hole assembly 28, as shown in FIG. 5. A series of sections of casing 20 were first pre-assembled and suspended from the upper trolley 16 as shown in FIG. 3. Then, when the bottom hole assembly 28 has been removed, the trolley 16 can be rolled into place within the derrick 12 so that the casing 20 may be lowered into the hole 36. In some embodiments, it may be desirable to add one more joint of casing to the pre-hung casing before lowering the casing 20 into the hole. The smaller diameter casing 20 is moved with the trolley 16 into a main moon pool and then lowered into the hole as shown in FIG. 5.

Figure 6:
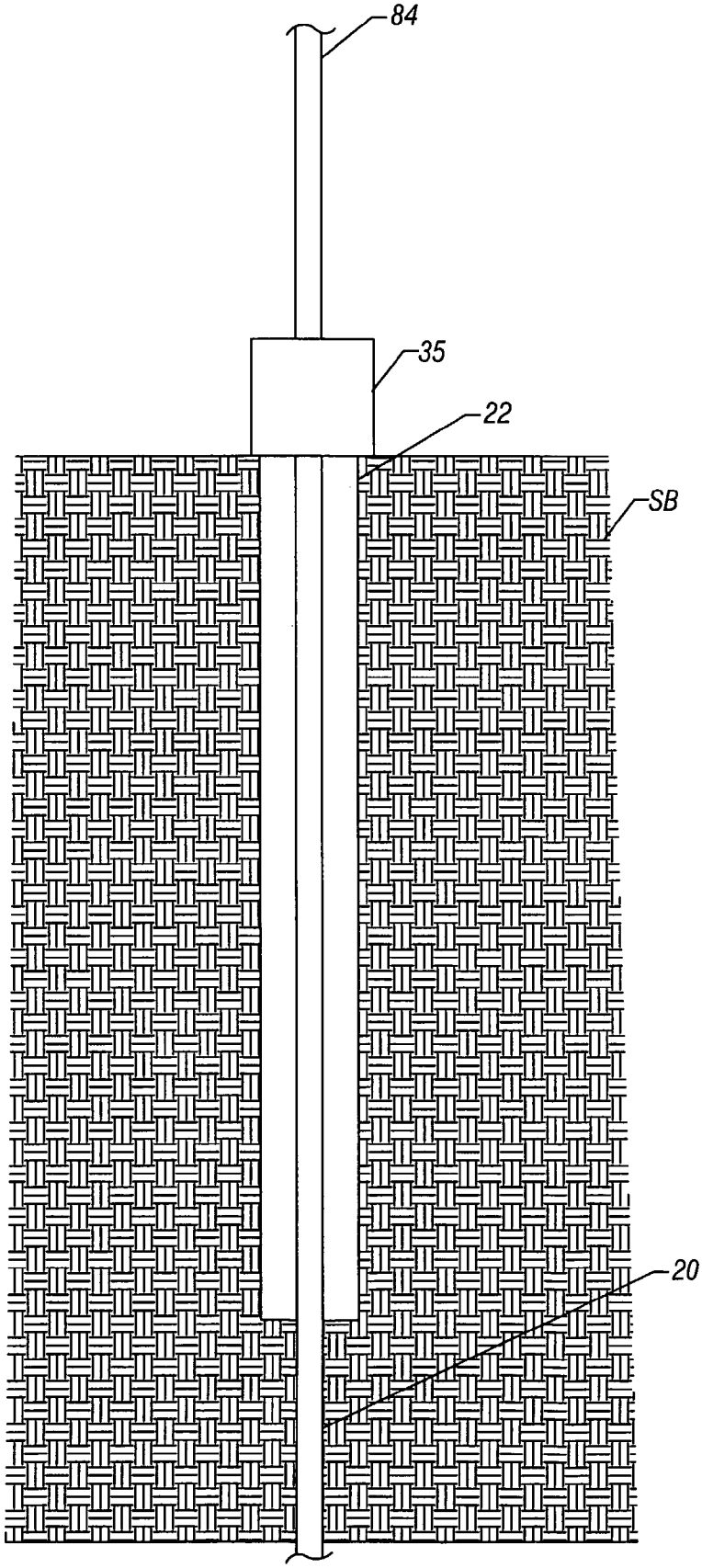
FIG. 6 is an enlarged, cross-sectional view showing the portion of the well within the seabed floor, the guide base, and the overlying blowout preventer and riser in accordance with one embodiment of the present invention.

More particularly, the casing 20 is provided through the guide base 35 into the hole 36 to a desired depth. As shown in FIG. 6, the casing 20 extends some depth into the seabed floor, passing through the larger diameter casing 22. The smaller diameter casing 20 may be cemented in position. Then, the string 84 is pulled out of the hole.

Figure 7:
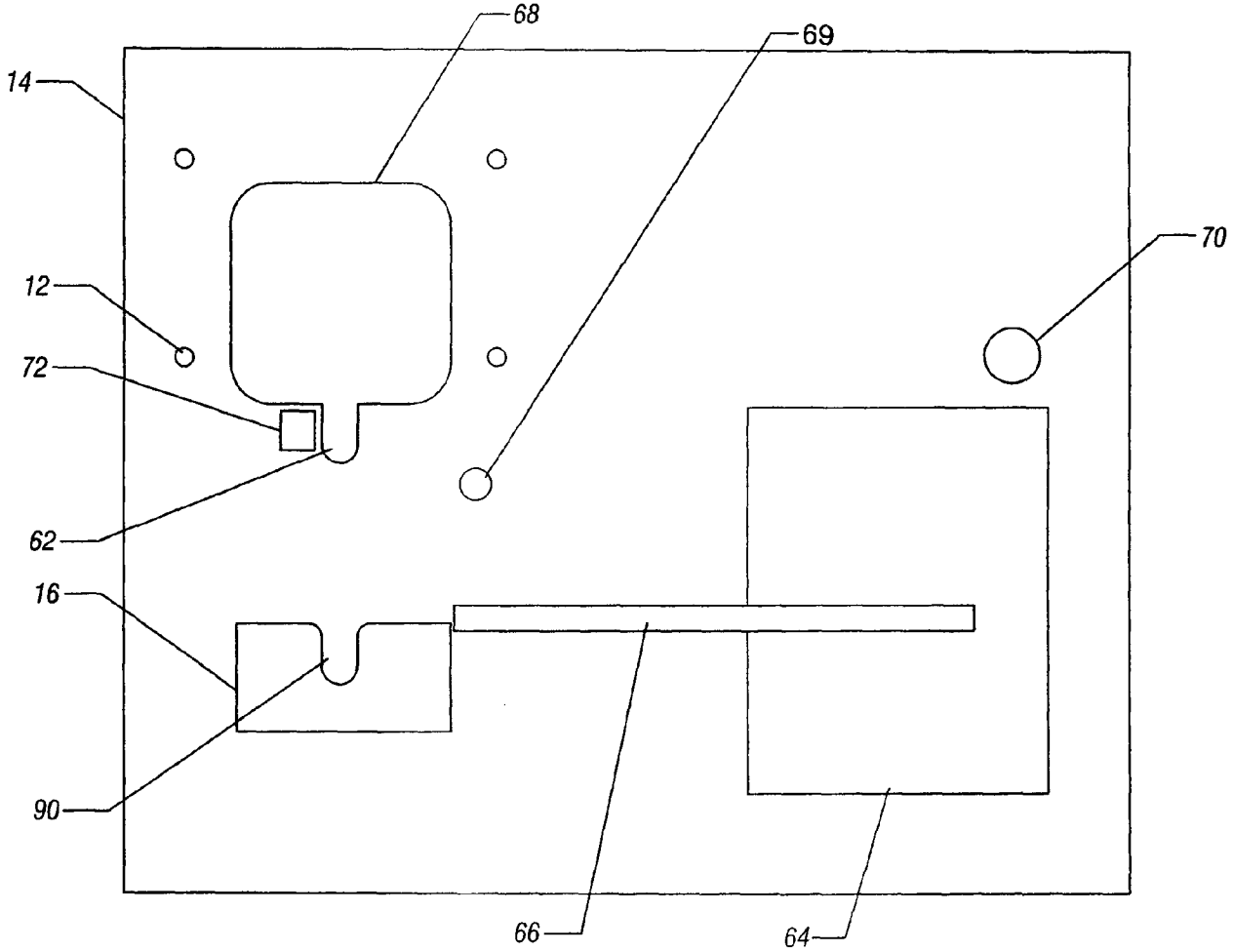
FIG. 7 is an enlarged, cross-sectional view taken generally along the line 7-7 in FIG. 1 in accordance with one embodiment of the present invention.

Referring to FIG. 7, the arrangement of the deck 14, in accordance with one embodiment of the present invention, is illustrated. The position of the derrick 12 is shown. The moon pool 68 has an extension 62 which points towards the upper trolley 16. The upper trolley 16 includes a slot 90, arranged to mate with the extension 62 on the moon pool 68.

Thus, the trolley 16 may be advanced to the extension 62 where the made up, hung off, casing 20 has been pre-positioned. The trolley 16 is positioned so that the slot 90 overlays the extension 62. The tool 72 then lifts the casing 20 from the extension 62 and mounts it on the trolley 16. The trolley 16 thereafter advances over the moon pool 68 so that the casing 20 may be lowered into the hole 36.

The casing 20 may be stored horizontally on racks 64 and advanced by a conveyor 66. The casing 20 then may be rotated to a vertical orientation and transferred by a crane 69 into the extension 62. A larger crane 70 may be utilized to support operations through the moon pool 68.

Figure 8:
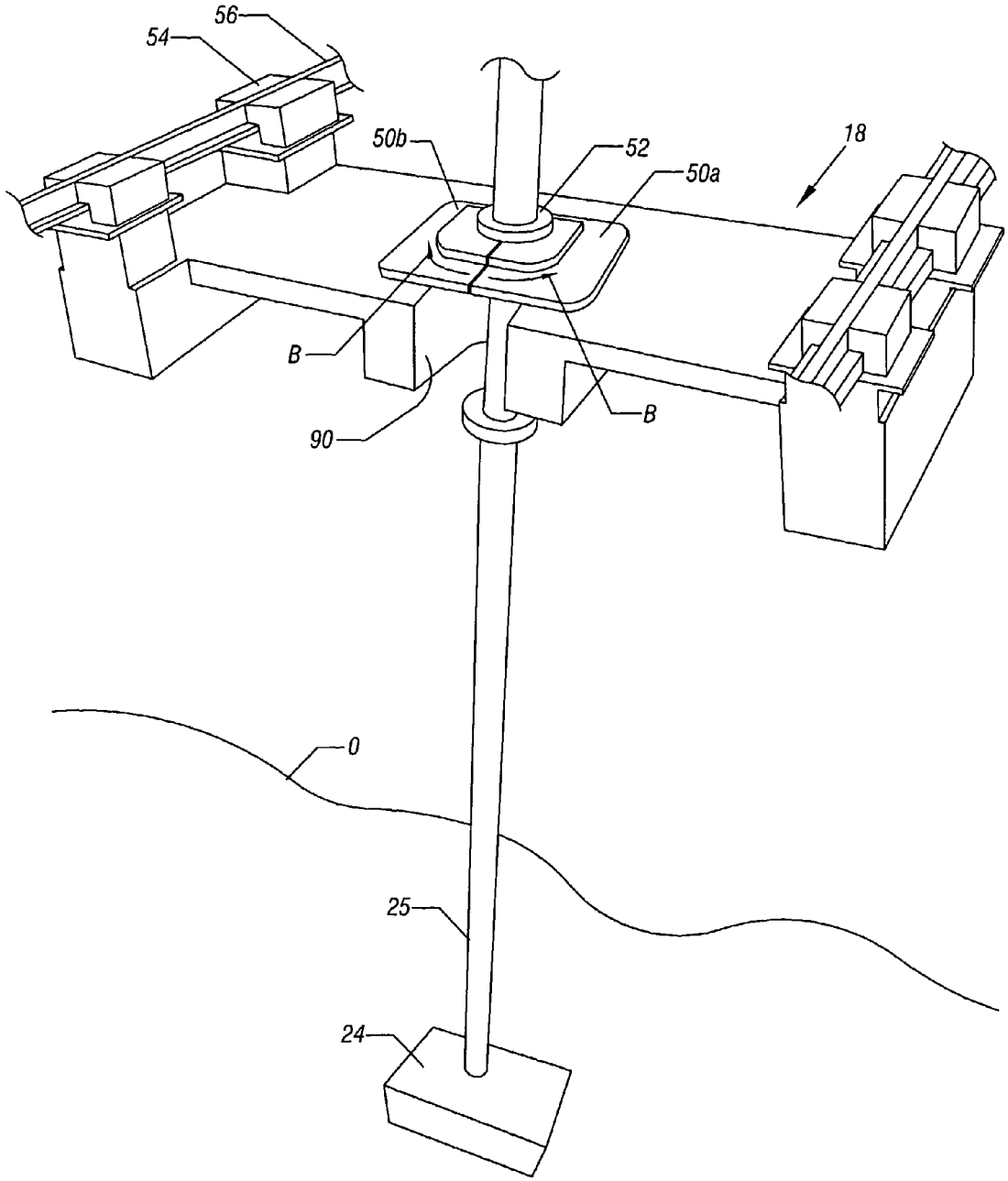
FIG. 8 is a partial, enlarged, perspective view of the lower trolley, riser, and blowout preventer hung off of the rig in accordance with one embodiment of the present invention.

Referring next to FIG. 8, the lower trolley 18 supports the riser 25 and the blowout preventer 24, which has already been pre-hung from the lower trolley 18. The lower trolley 18 may ride on bearings 54, supported by a track 56 on the deck 14. A split spherical bearing 50 includes portion 50*a* and 50*b* and is openable in the directions indicated by the arrows B. In other words, the bearing 50 includes two portions 50*a* and 50*b* which support the riser 25 on the ring 52 thereof. When the bearing 50 is opened, the riser 25 and blowout preventer 24 may be lifted from the trolley 18 and moved into the moon pool 68.

Figure 9:
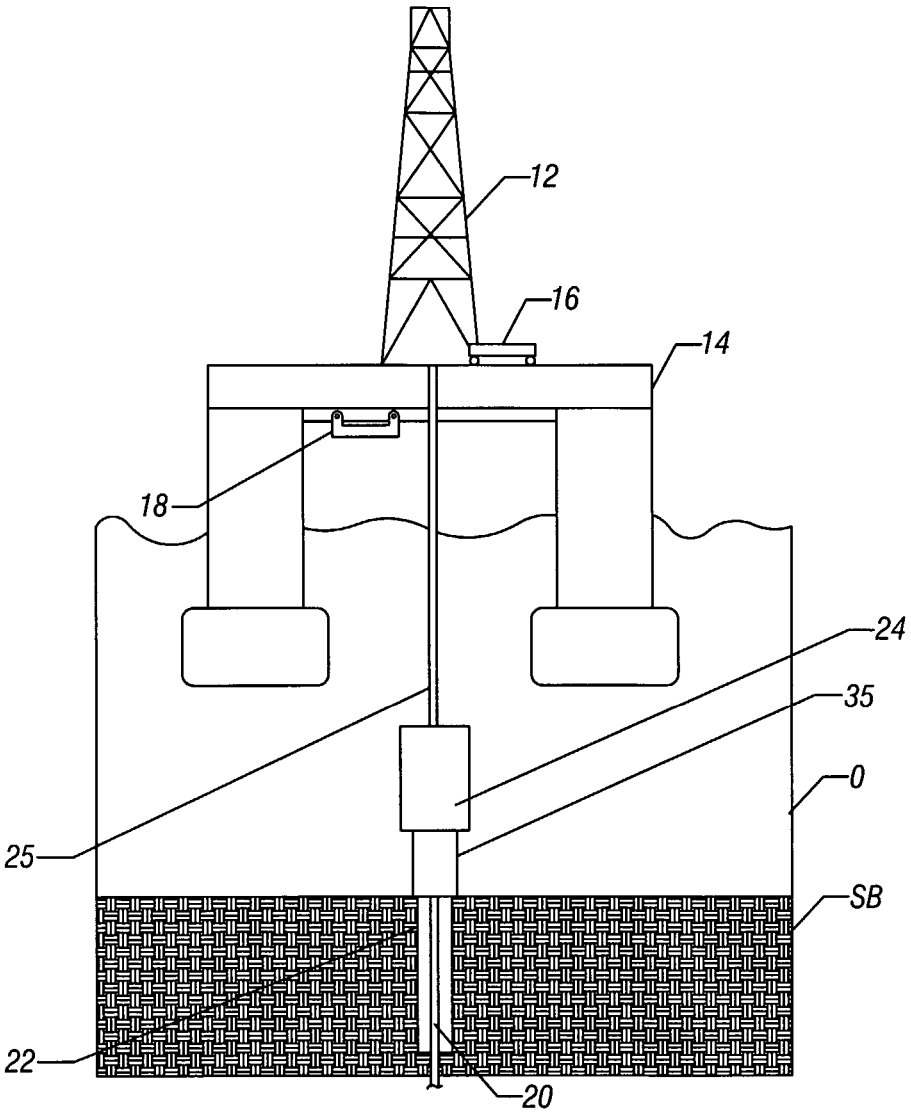
FIG. 9 is a cross-sectional view of the well with the blowout preventer and riser in position in accordance with one embodiment of the present invention.

Finally, referring to FIG. 9, the riser 25 and blowout preventer 24, once in position under the derrick 12, may be lowered into position and secured to the guide base 35. After the sequence described herein, conventional completion and production techniques may be used.

Once the well is completed, and it is desired to move to another location, the operation may be reversed. The blowout preventer 24 and riser 25 may be removed from the guide base 35, reattached to the trolley 18, and moved to the stored position shown in FIG. 1. Then, the rig 10 may be moved to a new location with the blowout preventer 24 and riser 25 hung off from the rig 10.

In some embodiments of the present invention, substantial time may be saved in offshore drilling operations. These savings arise by virtue of the fact that multiple operations may be done in a parallel, rather than serially. For example, the smaller diameter casing 20 is pre-made up and, therefore, the time to make up the casing does not add to the overall drilling time. That is, the casing 20 was made up while the casing 22 was being jetted in. Likewise, the cementing and the running in of the smaller diameter casing 20 may be partly done offline, as may be the removal of the landing string from the hole. Finally, the time to run in the blowout preventer 24 may be substantially shortened because the blowout preventer 24 has already been made up and hung off, offline.

Thus, in some cases, from 2 to 4 days may be saved over other techniques when drilling in water depths on the order of 5000 feet. Of course, the present invention is in no way limited to any particular drilling depth and may be applicable to any of a variety of well depths. While a floating embodiment is depicted, fixed or stationary platforms may also be used in some cases.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

hanging off a first casing from a trolley mounted on an offshore drilling platform;

positioning a second casing having a larger diameter than the first casing without using said trolley when said first casing is hanging off from the trolley;

repositioning the first casing by rolling the trolley into a position over the second casing when the second casing is in position within the seabed floor;

jetting in the second casing; and inserting a drill string through the second casing to drill a hole for the first casing.

2. The method of claim 1 including lowering the first casing into the hole below the second casing.

3. The method of claim 1 including hanging off a blowout preventer and riser from said platform.

4. The method of claim 3 including hanging off said blowout preventer and riser from a lower trolley on said platform while hanging off said first casing from said trolley mounted on said platform and positioning said second casing.

5. The method of claim 4 including providing an extension on a moon pool in said platform and providing a mating extension on said trolley mounted on said platform to enable said first casing to be lifted from said moon pool extension and positioned over said moon pool.

6. A method comprising:

hanging off a first casing from a trolley mounted on an offshore drilling platform;

positioning a second casing having a larger diameter than the first casing without using said trolley when said first casing is hanging off from the trolley;

repositioning the first casing by rolling the trolley into a position over the second casing when the second casing is in position within the seabed floor;

hanging off a blowout preventer and riser from said platform; and hanging off said blowout preventer and riser from a lower trolley on said platform while hanging off said first casing from said trolley mounted on said platform and positioning said second casing.

7. The method of claim 6 including jetting in the second casing.

8. The method of claim 7 including inserting a drill string through the second casing to drill a hole for the first casing.

9. The method of claim 8 including lowering the first casing into the hole below the second casing.

10. The method of claim 9 including providing an extension on a moon pool in said platform and providing a mating extension on said trolley mounted on said platform to enable said first casing to be lifted from said moon pool extension and positioned over said moon pool.

* * * * *